US006984025B2

(12) United States Patent
Kaneko et al.

(10) Patent No.: US 6,984,025 B2
(45) Date of Patent: Jan. 10, 2006

(54) INK JET HEAD

(75) Inventors: Mineo Kaneko, Tokyo (JP); Ken Tsuchii, Kanagawa (JP); Keiichiro Tsukuda, Kanagawa (JP); Masaki Oikawa, Tokyo (JP); Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 10/419,131

(22) Filed: Apr. 21, 2003

(65) Prior Publication Data

US 2004/0004648 A1 Jan. 8, 2004

(30) Foreign Application Priority Data

Apr. 23, 2002 (JP) ..... 2002-121156
Apr. 18, 2003 (JP) ..... 2003-114484

(51) Int. Cl.
*B41J 2/05* (2006.01)

(52) U.S. Cl. ..... 347/61
(58) Field of Classification Search ..... 347/61, 347/65, 47, 56, 75
See application file for complete search history.

(56) References Cited

U.S. PATENT DOCUMENTS

| | | | | |
|---|---|---|---|---|
| 4,646,110 | A | 2/1987 | Ikeda et al. | 347/15 |
| 5,072,242 | A | 12/1991 | Onhisi et al. | 347/54 |
| 5,172,139 | A | 12/1992 | Sekiya et al. | 347/15 |
| 6,139,761 | A | 10/2000 | Ohkuma | 216/27 |
| 6,174,049 | B1 | 1/2001 | Tachihara et al. | 347/65 |
| 6,224,191 | B1 | 5/2001 | Saito et al. | 347/48 |
| 6,354,698 | B1 | 3/2002 | Tachihara et al. | 347/56 |
| 6,561,632 | B2 * | 5/2003 | Feinn et al. | 347/65 |
| 2002/0063756 | A1 | 5/2002 | Tsuchii et al. | |

FOREIGN PATENT DOCUMENTS

| | | |
|---|---|---|
| EP | 0 775 580 | 5/1997 |
| EP | 0 803 361 | 10/1997 |
| JP | 59-124865 | 7/1984 |
| JP | 62-264957 | 11/1987 |
| JP | 5-286135 | 11/1993 |
| JP | 8-48034 | 2/1996 |
| JP | 9-11479 | 1/1997 |
| JP | 11-188870 | 7/1999 |
| JP | 2000-185403 | 7/2000 |
| JP | 2001-219563 | 8/2001 |

* cited by examiner

*Primary Examiner*—Thinh Nguyen
(74) *Attorney, Agent, or Firm*—Fitzpatrick, Cella, Harper & Scinto

(57) ABSTRACT

An ink jet head includes a substrate provided with heat generating members for generating a bubble in ink on a surface of the substrate, a plurality of discharge ports for discharging the ink, the ports opposed to the surface of the substrate, and a plurality of ink flow passages communicating with the plurality of discharge ports to feed the ink. A plurality of the heat generating members is provided in each of the ink flow passages, and the discharge port is arranged on an extension line extending from a center of a pressure generating area composed of the plurality of heat generating members toward the surface of the substrate in a normal direction. Moreover, a distance dhc between centers of each of two heat generating members arranged most apart from each other among the plurality of heat generating members is set to be larger than a diameter do of an aperture of the discharge port. In the ink jet head, even if the center position of the discharge port and the center position of the pressure generating area are somewhat shifted from each other, main liquid droplets of the ink are discharged from the discharge port without generating no shift in their discharge directions.

9 Claims, 10 Drawing Sheets

INK JET HEAD

BACKGROUND OF THE INVENTION

1. Field of the Invention

The present invention relates to an ink jet head for performing record by discharging ink to a recording medium.

2. Description of Related Art

In recent years, an ink jet recording apparatus has been widely used especially as an output device of a computer because a high definition character and an image can easily be obtained by means of the ink jet recording apparatus. Inter alia, the bubble jet system for discharging ink from nozzles by means of a sudden pressure change produced by boiling the ink in the nozzle rapidly has become the main stream of the ink jet recording apparatus since many nozzles can easily be arranged in a high density in a simple configuration by the bubble jet system.

Moreover, as the ink jet recording apparatus has been widely spread in recent years, demands for the performances of the ink jet recording apparatus, especially for the image quality thereof and the recording speed thereof, have been increased. For the improvement of the image quality, it is important to reduce the diameters of dots recorded on a recording medium (especially on a sheet of recording paper). The demand is remarkable in case of the record of images represented by a photographic image in comparison with character documents. For example, the resolution necessary for obtaining the beauty of characters or for resolving small characters in the record of a character document is within a range from 600 dpi to 1200 dpi, and it is consequently enough for obtaining the resolution that the diameters of dots of liquid droplets to be discharged are within a range from about 80 $\mu$m to 90 $\mu$m (about 30 pl in case of being expressed by the volume).

On the other hand, in case of performing image record, the resolution, for example, for expressing smooth gradation equivalent to that of a film photo is required to be within a range from 1200 dpi to 2400 dpi. If the diameters of dots of liquid droplets to be discharged are 40 $\mu$m (about 4 pl in case of being expressed by the volume) in case of record with the resolution mentioned above, it is required to use two kinds of inks having the densities of dyes different from each other by the degree from about ¼ to ⅙ properly according to the densities of images. If the diameters of dots of liquid droplets to be discharged are made to be as small as about 20 $\mu$m (0.5 pl in case of being expressed by the volume), both of the requirements for density in a high density part and for smoothness in a low density part can be satisfied without any conflict by means of a kind of ink of a single density. As described above, it is essential for obtaining an image quality equivalent to a film photo to achieve the reduction in size of the liquid droplets to be discharged.

An ink jet head configured to discharge small liquid droplets is required to increase the number of times of discharging liquid droplets per a unit time. Consequently, the amount of current flowing a heat generating member increases, which in turn generates a large voltage drop at a parasitic resistance in a wiring section up to the heat generating member. Thus, the ink jet head has a problem of a decrease of its discharge efficiency. For preventing the decrease of the discharge efficiency, a method for decreasing current values by increasing the resistance value of the heat generating member is effective. It can be considered to increase the resistance value of the material of the heat generating member as means for increasing the resistance. However, there is a limit in increasing the resistance value by changing the material of the heat generating member. Besides, if a new material is used, a necessity to examine the new material fully whether there is some functional problem or not is generated. The change of the material of the heat generating member is difficult to realize. Accordingly, the increase of the resistance can be realized by dividing the heat generating member into a plurality of pieces to be connected in series and by arranging the pieces in an ink flow passage.

However, it was found that a new problem is produced as another problem in case of arranging the heat generating member after dividing it into a plurality of pieces.

Since the structure of an ink jet head is fine, as shown in FIGS. 10A and 10B, there is a case where the center of a heat generating member 1102 provided on a substrate 1101 and the center of a discharge port 1104 provided on a flow passage forming member 1103 are shifted from each other owing to the dispersion generated in a manufacturing process. A reference numeral 1105 designates an ink flow passage, and a reference numeral 1106 designates an ink feed passage.

SUMMARY OF THE INVENTION

The shifting of relative positions of the heat generating member 1102 and the discharge port 1104 is not so serious problem in a conventional single heat generating member 1102. However, if the relative positions of the heat generating member 1102 and the discharge port 1104 are shifted from each other in the case where the heat generating member 1102 is arranged by being divided into a plurality of pieces, it can be found that a minute liquid droplet is placed at a position separated from the position of the main liquid droplet, which mars the image definition, as shown in FIG. 11. In particular, since the misdirection of a discharge direction seriously affects an image in case of a smaller ink liquid droplet in comparison with a conventional ink liquid droplet, it is further required to make it difficult to generate the misdirection of the discharge direction in comparison with in the case of the prior art.

The inventor of the present invention found out that the misdirection of the discharge direction was caused by the dispersion of the resistances and the shapes of heat generating members provided in the same flow passage and by the minute dispersion of the performances such as the thicknesses of the heat generating members in case of using the plurality of heat generating members, and that an ink jet head could adopt a structure in which the misdirection of the discharge direction was easily affected according to the position of the discharge port. Then, the inventor investigated a configuration for achieving a suitable layout of the discharge port to the heat generating members.

Accordingly, the present invention aims to provide an ink jet head capable of discharging ink liquid droplets from a discharge port efficiently without any discharge direction shifts even if the center position of the discharge port and the center position of a pressure generating area are somewhat shifted from each other.

For achieving the object mentioned above, an ink jet head of the present invention includes a substrate provided with heat generating members for generating a bubble in ink on a surface of the substrate, a plurality of discharge ports for discharging the ink, the ports opposed to the surface of the substrate, and a plurality of ink flow passages communicating with the plurality of discharge ports to feed the ink, the ink jet head discharging the ink from the discharge ports by a pressure generated by generating the bubble, wherein a plurality of the heat generating members is provided in each of the ink flow passages, and the discharge port is arranged on an extension line extending from a center of a pressure generating area composed of the plurality of heat generating members toward the surface of the substrate in a normal direction; and a distance dhc between centers of each of two heat generating members arranged most apart from each other among the plurality of heat generating members is set to be larger than a diameter do of an aperture of the discharge port.

According to the ink jet head of the present invention, even if the center position of the discharge port and the center position of the pressure generating area are somewhat shifted from each other, the influence of the distribution of foaming in the plurality of heat generating members, and the possibility of touches of the liquid columns of the ink discharged through the discharge port to the side walls of the discharge port is remarkably decreased. Consequently, the main liquid droplets of the ink are discharged from the discharge port without any shifts of the discharge directions. Moreover, if the liquid columns do not touch the side wall surfaces of the discharge walls of the discharge port, the parts where the main droplets are separated from the liquid columns are fixed. Consequently, it becomes possible to stable the sizes of the main liquid droplets, namely the sized of the dots formed by the main droplets placed on a sheet of recording paper, or the like.

Moreover, by adopting the configuration in which these plural heat generating members are connected to each other in series electrically with wiring, a resistance value higher than that of a single heat generating member having the same size as that of the plural heat generating members can be obtained, which makes it possible to reduce the necessary current value. Consequently, if the speed of discharge operation is intended to be high as discharged liquid droplets become smaller, it is possible to suppress the increase of current quantities flowing through the heat generating members. Moreover, it is possible to suppress heat generation and voltage drops owing to the resistance of a wiring section up to the heat generating members, and further to suppress induction noises generated by large currents flowing through the wiring section.

Moreover, by adopting the configuration in which, when a shift quantity of the center of the discharge port to the extension line is designated by derr, the distance dhc, the diameter do of the aperture, and the shift quantity derr satisfy a relation: $dhc>do+derr\times2$, it becomes possible to place minute liquid droplets generated at separation portions between main liquid droplets and liquid columns at impact positions of the main droplets. Furthermore, it also becomes possible to stable the impact positions of the main liquid droplets. Consequently, the shapes and positions of dots formed by the placed liquid droplets can be stabled.

Moreover, by adopting the configuration in which at least two heat generating members among the plurality of heat generating members provided in each of the ink flow passages are arranged with a certain interval dhh with respect to a direction between partition walls partitioning each of the ink flow passages; and the interval dhh between two heat generating members adjoining to each other most apart from each other with respect to the direction between the partition walls among the plurality of heat generating members is twice or less as long as an interval dhn between each of the partition walls and the heat generating members adjoining the each of the partition walls, it is prevented that bubble remaining in ink stay in an area between the two heat generating members. Consequently, the stability of discharging ink is further heightened.

Moreover, an ink jet head of the present invention includes a substrate provided with heat generating members for generating a bubble in ink on a surface of the substrate, a plurality of discharge ports for discharging the ink, the ports opposed to the surface of the substrate, a plurality of ink flow passages communicating with the plurality of discharge ports to feed the ink, and a flow passage forming member provided on the surface of the substrate, the ink jet head discharging the ink from the discharge ports by a pressure generated by generating the bubble, wherein a plurality of the heat generating members is provided in each of the ink flow passages, and the discharge port is arranged on an extension line extending from a center of a pressure generating area composed of the plurality of heat generating members toward the surface of the substrate in a normal direction; and center lines of each of two heat generating members with respect to an ink flow direction are located at an outside of the discharge port projected above the pressure generating area, the heat generating members arranged most apart from each other with respect to the direction between partition walls partitioning each of the ink flow passages, the direction orthogonal to the ink flow direction flowing in each of the ink flow passages toward the pressure generating area, among the plurality of heat generating members.

According to the ink jet head of the present invention, even if the center position of the discharge port and the center position of the pressure generating area are somewhat shifted from each other, the deviations of the flight directions of the liquid droplets, which deviations can be produced by a heat generating member on one side of the two heat generating members, and the deviations of the flight directions of the liquid droplets, which deviations can be produced by the other heat generating member on the other side of the two heat generating members, are produced in the directions opposite to each other. Consequently, the deviations of the flight directions of the liquid droplets, which deviations can be produced by a heat generating member on one side, are cancelled by the deviations of the flight directions of the liquid droplets, which deviations can be produced by the other heat generating member on the other side. Therefore, the deviations of the flight directions of the liquid droplets can be reduced, and the discharge directions of the liquid droplets can be stabled.

Moreover, the configuration in which the bubble are debubbled without communicating with outside air through the discharge port may be adopted.

BRIEF DESCRIPTION OF THE DRAWINGS

FIG. 2A is a plan view thereof, and FIG. 2B is a sectional view thereof;

FIG. 4A is a plan view thereof, and FIG. 4B is a sectional view thereof;

FIG. 6A is a plan view thereof, and FIG. 6B is a sectional view thereof;

FIG. 7A is a plan view thereof, FIG. 7B is a view for the illustration of the arrangement of discharge port columns, and FIG. 7C is a sectional view thereof;

FIG. 10A is a plan view thereof, and FIG. 10B is a sectional view thereof;

DETAILED DESCRIPTION OF THE PREFERRED EMBODIMENTS

Next, the preferred embodiments of the present invention will be described by reference to the attached drawings.

First Embodiment

Figure 1:
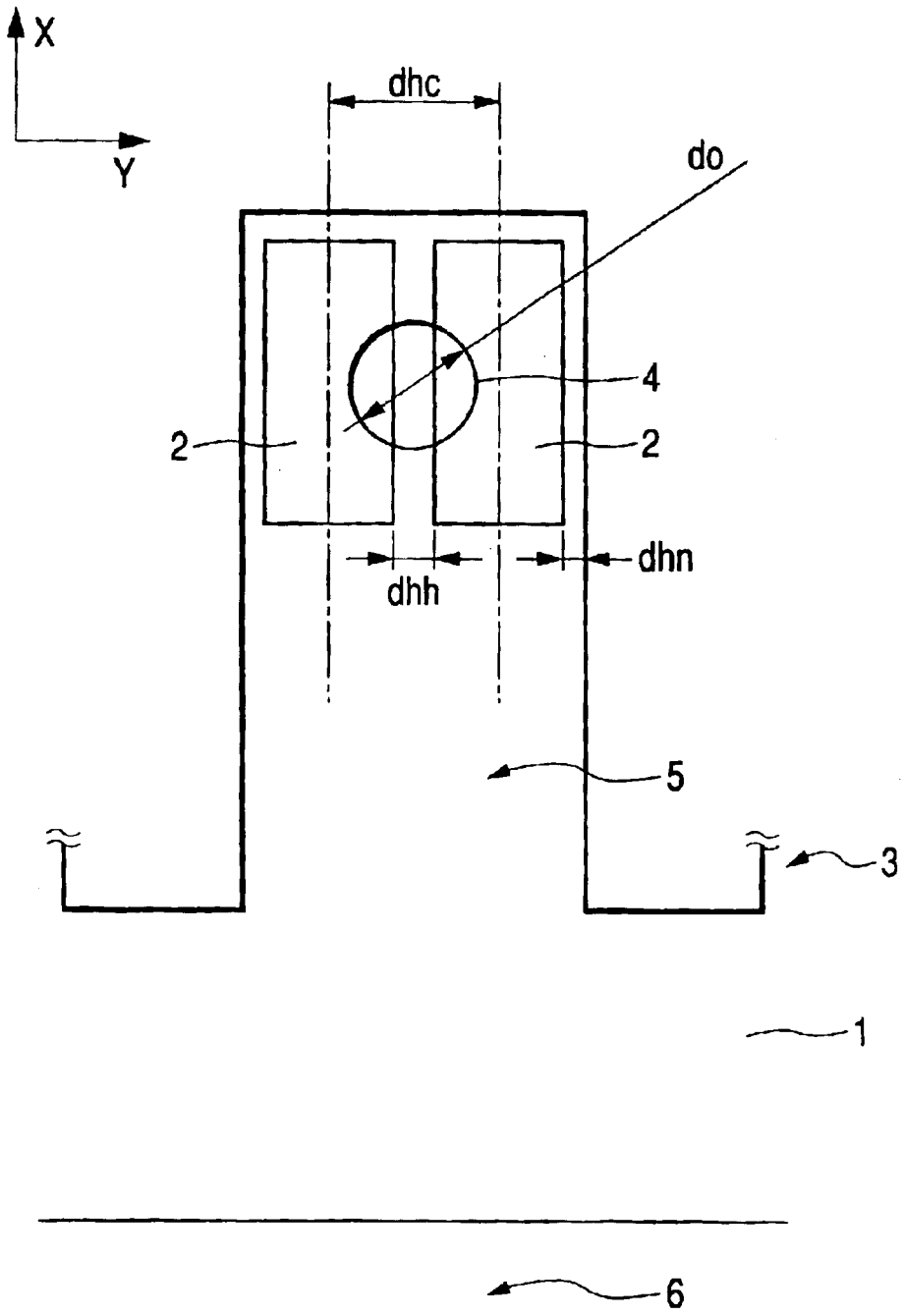
FIG. 1 is a transparent plan view showing an arrangement relationship of an ink flow path, heat generating members and a discharge port in an ink jet head of a first embodiment of the present invention.

FIG. 1 is a transparent plan view showing an arrangement relationship of an ink flow path, heat generating members and a discharge port in an ink jet head of a first embodiment of the present invention.

The ink jet head of the present embodiment includes a substrate 1 provided with many heat generating members 2 on the surface thereof, and a flow passage forming member 3 provided on the substrate 1. The flow passage forming member 3 includes partition walls 3*a* for partitioning the many heat generating members 2 into twos, and a ceiling wall 3*b* opposed to the substrate 1. The partition walls 3*a* form a plurality of ink flow passages 5 for feeding ink into pressure generating areas composed of the two heat generating members 2 partitioned by the partitioned walls 3*a*. Moreover, in each ink flow passage 5, a discharge port 4 is formed in the ceiling wall 3*b* on an extension line extending from the center of a pressure generation area, composed of two heat generating members 2, in the normal direction to the surface of the pressure generation area. Each ink flow passage 5 commonly communicates with an ink feed passage 6. The ink fed from ink feed means such as an ink tank (not shown) to the ink feed passage 6 is adapted to be fed into each ink flow passage 5 from the ink feed passage 6.

As described above, in the present embodiment, one pressure generation area composed of two heat generating members 2 is arranged in one ink flow passage 5 equipped with one discharge port 4. Moreover, a distance dhc between the centers of the two heat generating members 2 in each pressure generation area is set to be larger than a diameter do of the aperture of the discharge port 4. Thereby, even if the center position of the discharge port 4 is shifted from the center position of the heat generating members 2 at the time of the production of a recording head as shown in FIG. 2A, the influence of the dispersion of foaming in the plurality of heat generating members 2 becomes less, and a liquid column also does not touch side wall surfaces of the discharge port 4. Consequently, a main liquid droplet is discharged from the discharge port 4 without any shifting in its discharge direction.

Moreover, since the parts of the liquid columns at which the main droplets are separated from the liquid columns are made to be fixed when the liquid columns do not touch the side wall faces of the discharge port 4, it is possible to stabilize the sizes of the main droplets, i.e. the sizes of dots formed by the impact of the main droplets onto a sheet of recording paper or the like.

Figure 2B:
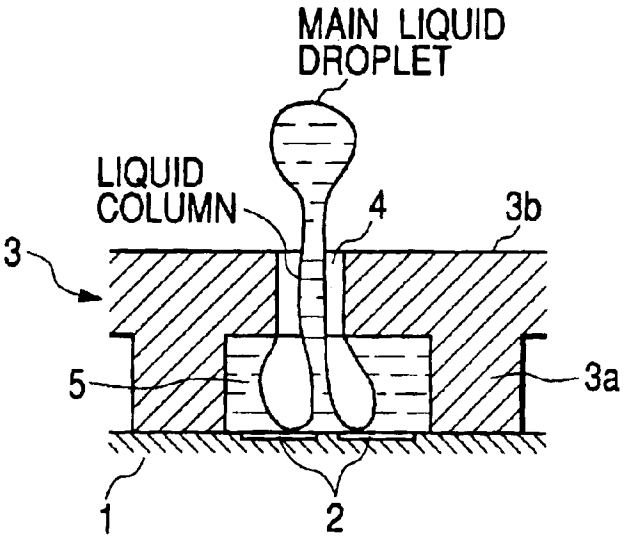
FIGS. 2A and 2B are views showing a case where the center position of the discharge port is shifted from the center position of two heat generating members in the ink jet head shown in FIG. 1.
Figure 2A:
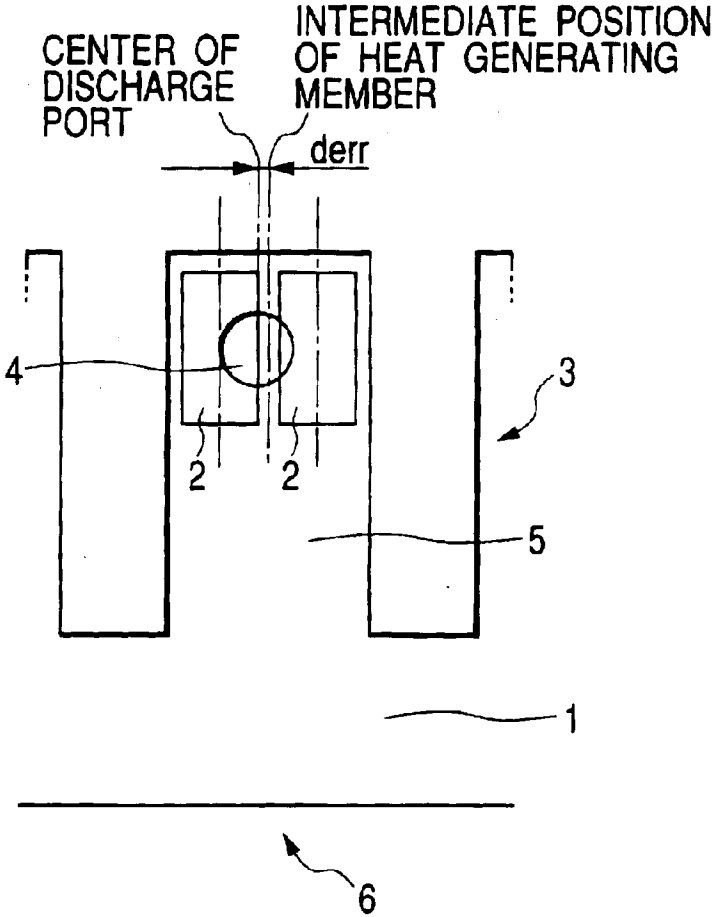

Moreover, in the configuration in which the discharge port 4 is arranged almost right above the center position of the pressure generation area composed of the two heat generating members 2 as in the present embodiment, the center of the discharge port 4 is shifted from the center position of each of the heat generating members 2 (namely, the center of the discharge port 4 is located at a position shifted from the positions almost right above the centers of respective heat generating members 2) as shown in FIGS. 2A and 2B. Consequently, the centers of air bubble generated by respective heat generating members 2 are out of the center of the discharge port 4. Therefore, the nearest part of liquid surface formed by the ink in the ink flow passage 5 to the interface with the outside air (i.e. the center part of the discharge port 4) becomes apart from the parts at which the bubble have most grown (i.e. the parts almost right above the centers of respective heat generating members 2). Consequently, the timing at which the bubble communicate with the outside air is delayed in comparison with the case where the center of the heat generating member 2 coincides with the center of the discharge port 4. Therefore, it becomes easy to form a state in which the bubble communicates with the outside air in the ink flow passage 5 as disclosed in Japanese Patent Laid-Open Application NO. 11-188870.

If the state in which the bubble communicate with the outside air in the ink flow passage 5 can be formed, a liquid column which extends from a position between the two heat generating members 2 through the discharge port 4 can be formed as shown in FIG. 2B. Thereby, the discharge directions of the main liquid droplets can be regulated within a predetermined range. Then, it becomes possible to make the discharge directions of the main droplets further stable.

An example of the present embodiment was designed as follows. That is, the diameter do of the aperture of the discharge port 4 was made to be 11 $\mu$m; the width of each heat generating member 2 was made to be 12 $\mu$m; the length thereof was made to be 27 $\mu$m; the arrangement interval dhh of the two heat generating members 2 from each other was made to be 3 $\mu$m; and the distance dhc between the centers of the two heat generating members 2 was made to be 14 $\mu$m. Moreover, the height of the ink flow passage 5 was made to be 13 $\mu$m; and the thickness (the width between the surface touching the substrate 1 and the surface at which the discharge port 4 was opened) of the flow passage forming member 3 was made to be 25 $\mu$m.

The ink jet head configured as above was arranged at a position where the surface on which the discharge ports 4 of the recording head were opened was distant from a sheet of recording paper (not shown) by 2 mm. While the ink jet head was scanned at the speed of 15 inches (about 38 cm)/second, current pulses of 0.9 μs were flown through the heat generating members 2. Thereby, ink droplets were discharged onto the recording paper. The operation was performed by means of several ink jet heads having different quantities derr of the relative misregistration of the center positions of the discharge ports 4 from the center positions of pressure generating areas composed of the two heat generating members 2.

Figure 3:
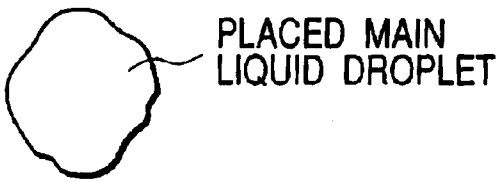
FIG. 3 is a view showing the shape of a dot formed by a liquid droplet discharged from the ink jet head shown in FIG. 1.

The relation between quantities derr of the relative misregistration of the center positions of the discharge ports 4 from the center positions of the pressure generating areas composed of the two heat generating members 2 and the shapes of dots of ink liquid droplets placed on the recording paper was analyzed on the basis of the ink liquid droplets placed on the recording paper. The analysis taught that the shapes of the dots became good shapes of dots without any satellite dots caused by minute liquid droplets to be generated at separation parts between the main liquid droplets and the liquid columns, as shown in FIG. 3, and that there was almost no dispersion of discharge directions, if the quantities derr of the relative misregistration were within a range smaller than 2 μm inclusive. However, if the quantities derr of the relative misregistration exceeded 2 μm, the satellite dots gradually became more distant from the dots of the main liquid droplets and the dispersion of the positions of placed liquid droplets became larger, as the quantities derr of the relative misregistration became larger.

Consequently, it was known that it was preferable to set the distance dhc between the centers of the two heat generating members 2 larger than the distance equal to (the diameter do of the aperture of the discharge port 4)+(the quantity derr of relative misregistration×2).

Moreover, if the area generating no heat that is formed between adjoining heat generating members 2 is too wide, a bubble remaining ink stay in the area, and the remaining bubble absorbs a discharge pressure to be generated at the time of foaming. For preventing the phenomenon, it is preferable to set the interval dhh of the two heat generating members 2, where no heat is generated, twice or less as long as the intervals dhn between the ends of respective heat generating members 2 which adjoin the partition walls 3*a* and the partition walls 3*a*. To put it concretely, if the intervals dhn are about 2 μm, it is preferable to set the interval dhh is equal to or less than 4 μm.

Figure 12:
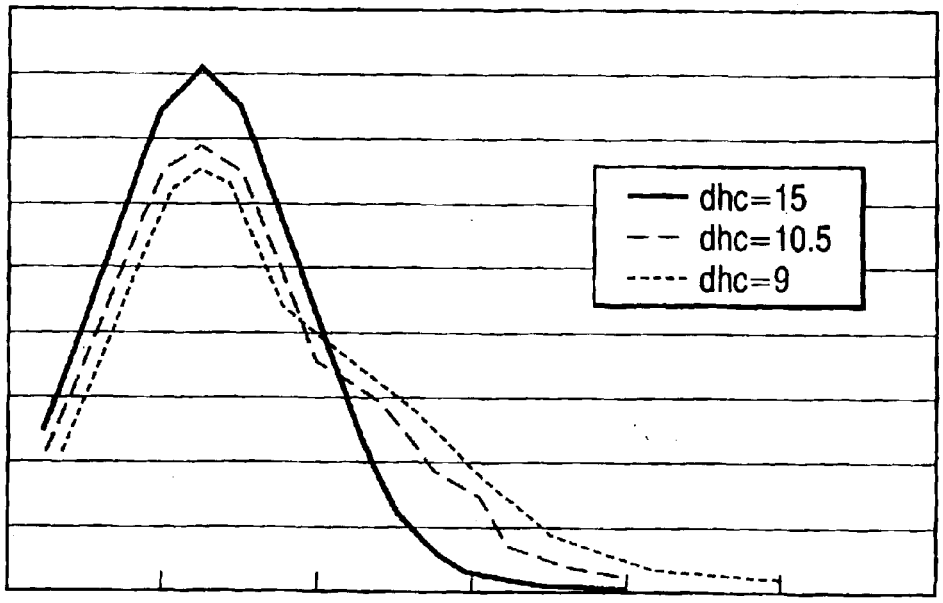
FIG. 12 is a view showing distribution of printing misdirections in the first embodiment.

The influences to printing in the present embodiment at the time when the distance dhc between the centers of respective heat generating members 2 is changed without changing the diameter do of the aperture of the discharge port 4 are fixed are illustrated in FIG. 12. FIG. 12 shows distributions of printing misdirections. The ordinate axis of FIGS. 2A and 2B indicates the number of heads, and the abscissa axis of FIGS. 2A and 2B indicates the quantity of maximum misdirections. As apparent from the figure, it is known that nozzles having larger misdirections increase as the distance dhc becomes smaller owing to the influence of alignment shifting.

Moreover, a judgment of these heads by means of a prescribed pattern for examining misdirections, satellites and the like showed the results such that the efficiency percentages of printing are 99% at dhc=15, 95% at dhc=13, 90% at dhc=10.5, and 85% at dhc=9.

It is known that the present invention is very useful from these results also.

Figure 10B:
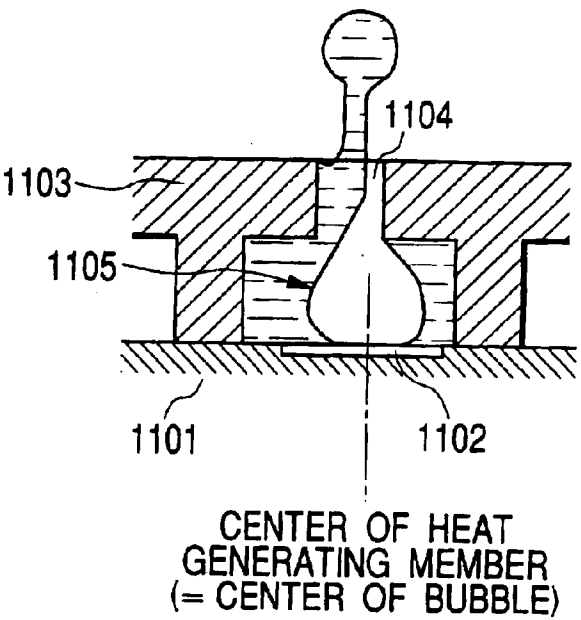
FIGS. 10A and 10B are views showing an arrangement relationship of an ink flow passage, heat generating members and a discharge port of a conventional ink jet head.
Figure 10A:
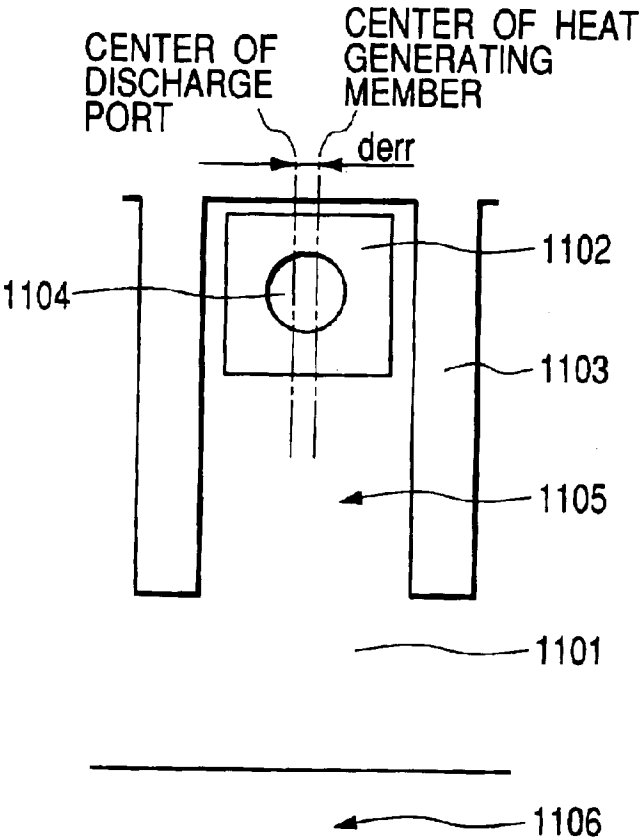
Figure 11:
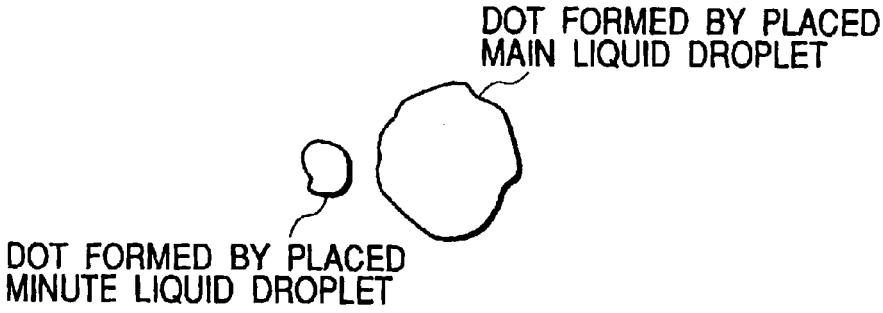
FIG. 11 is a view showing the shapes of dots formed by liquid droplets discharged from the conventional ink jet head.

Moreover, the present embodiment has the configuration in which the two heat generating members 2 having an elongated shape as described above are connected in series electrically with wiring. Thereby, resistance values from three and a half times to six times as high as the resistance value of the conventional heat generating members 1102 having comparatively large area shown in FIGS. 10A and 10B can be obtained. Consequently, it becomes possible to make necessary current values about half of the conventional ones. Thereby, the increases of the quantities of currents flowing through the heat generating members 2 can be suppressed even if the increase of the speed of the discharge operation of the ink jet head is achieved as the discharge liquid droplets become smaller. Furthermore, it is possible to suppress the generation of heat and voltage drops owing to the resistance of wiring sections up to the heat generating members 2, and induced noises generated by large currents flowing through the wiring sections.

Incidentally, proposals of arranging divided heat generating members were submitted in the past in response to the electric request of suppressing the increase of the quantity of currents in the case where the increase of the speed of the discharge operation of the ink jet head is achieved as the discharge liquid droplets become smaller, and from the point of view of preventing the heat generating members from getting a shock owing to cavitation breakdowns, which are generated at the time when boiled bubble is collapsed by negative pressures in their insides. However, the present embodiment examined the optimum arrangement relationship of the heat generating members 2 to the ink flow passage 5 and the discharge port 4 from the point of view of how the plural heat generating members 2, namely a plurality of pressure generating sources, arranged in one ink flow passage 5 influence discharge performances. Such an example has not proposed in the past.

Second Embodiment

Figure 4B:
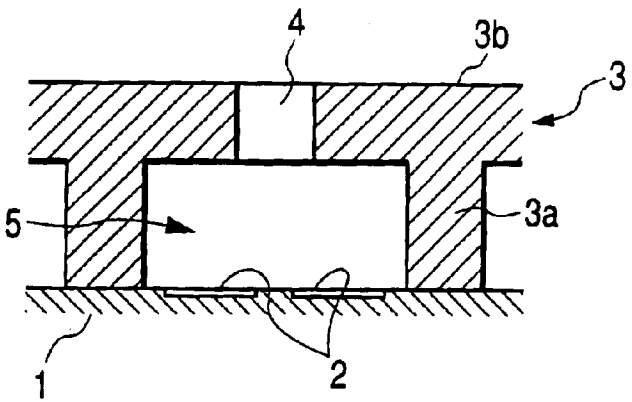
FIGS. 4A and 4B are views showing an arrangement relationship of an ink flow passage, heat generating members and a discharge port of an ink jet head of a second embodiment of the present invention.
Figure 4A:
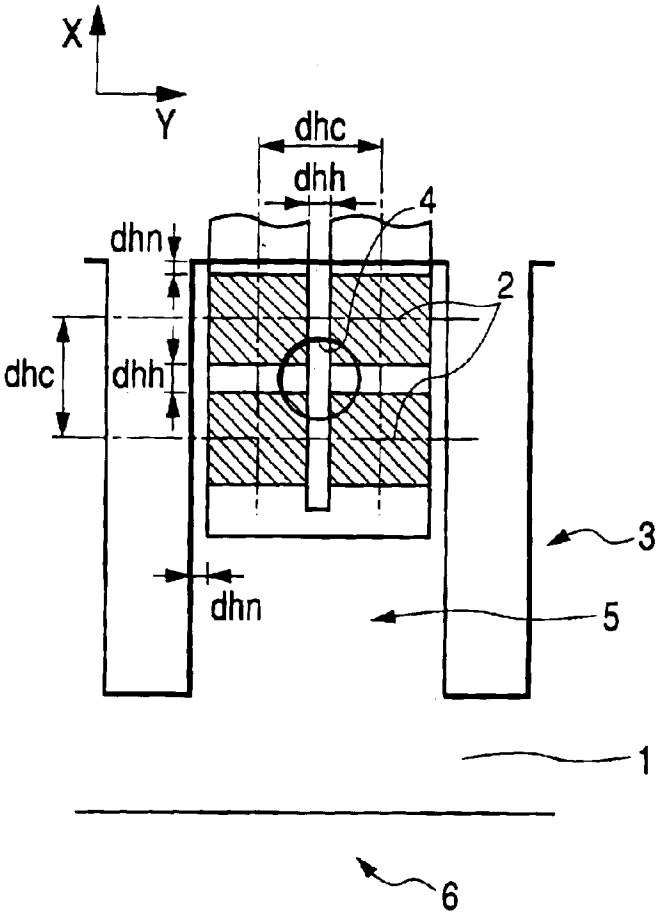

FIGS. 4A and 4B are views showing an arrangement relationship of an ink flow passage, heat generating members and a discharge port of an ink jet head of a second embodiment of the present invention. FIG. 4A is a plan view thereof, and FIG. 4B is a sectional view thereof.

As shown in FIG. 4A, especially, the ink jet head of the present embodiment is provided with a pressure generating area composed of four-in-a-set heat generating members 2 in one ink flow passage 5. Supposing that the ink flow direction in the ink flow passage 5 is an X direction and a direction orthogonal to the X direction is a Y direction, these heat generating members 2 are arranged in the way in which two of them are arrange in the X direction and two of them are arranged in the Y direction. Moreover, these heat generating members 2 are connected in series electrically by wiring. A discharge port 4 is arranged on an extension line extending from the center of the pressure generating area composed of the four heat generating members 2 in the normal direction to the surface of the-pressure generating area.

Also in the present embodiment, as is the case with the first embodiment, the distance dhc between the centers of the adjoining heat generating members 2 is set to be larger than the distance equal to (the diameter do of the aperture of the discharge port 4)+(the quantity derr of relative misregistration×2), and the interval dhh of the heat generating members 2 is set to be twice or less as long as the intervals dhn between the ends of respective heat generating members 2 which adjoin the partition walls 3*a* and the partition walls 3*a*.

According to the configuration of the present embodiment, liquid columns do not touch the side wall surfaces of the discharge port 4 even if the center position of the discharge port 4 to the center position of the pressure generating area is shifted not only in the Y direction, but also in the X direction. Consequently, main liquid droplets are discharged from the discharge port 4 without producing any shifts in their discharge directions. Furthermore, the sizes of the main droplets, i.e. the sizes of the dots formed by placed main droplets on a sheet of recording paper or the like, can be stabled.

As described above, the first embodiment adopts the configuration for producing its effect in the case where the center position of the discharge port 4 to the center position of the pressure generating area composed of the two heat generating members 2 is shifted in the Y direction. On the other hand, the present embodiment is configured to produce an effect in the case where the center position of the discharge port 4 to the center position of the pressure generating area is shifted not only in the Y direction, but also in the X direction. Consequently, the present embodiment can perform the discharge of liquid droplets further stably.

Incidentally, the ink jet head of the present invention can be applied not only to the case where two or four heat generating members 2 are provided in one ink flow passage 5 like the first and the second embodiments, but also to all of the cases where a plurality of (two or more) heat generating members 2 are provided in one ink flow passage 5.

In the latter case, the distance dhc is defied as "a distance between the centers of the heat generating members arranged at the most distant positions from each other among a plurality of heat generating members", and the interval dhh is defined as "an interval between two heat generating members adjoining to each other with the most distant space with regard to a direction between the partition walls partitioning the ink flow passage".

Third Embodiment

Figure 5:
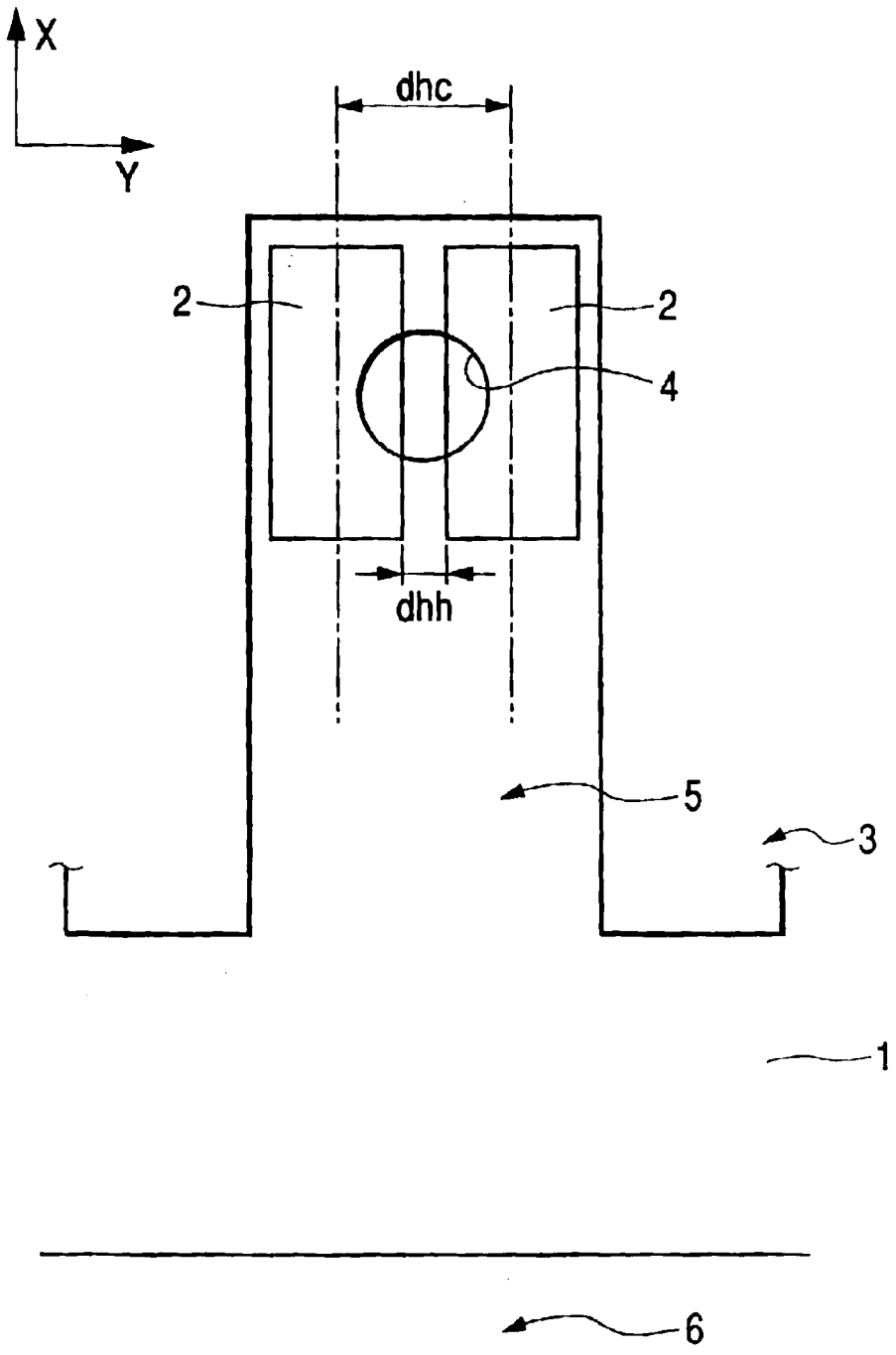
FIG. 5 is a transparent plan view showing an arrangement relationship of an ink flow passage, heat generating members and a discharge port of an ink jet head of a third embodiment of the present invention.

FIG. 5 is a transparent plan view showing an arrangement relationship of an ink flow passage, heat generating members and a discharge port of an ink jet head of a third embodiment of the present invention.

As in the case with the first embodiment, the third embodiment is provided with two heat generating members 2 which have a slender shape and are arranged in one ink flow passage 5. The other configurations of the recording head are also the same as those of the first embodiment.

In the present embodiment, the width of each heat generating member 2 was set to be 11 $\mu$m; the length thereof was set to be 27 $\mu$m; the interval dhh of the two heat generating members 2 was set to be 4 $\mu$m; and the distance dhc between the centers of the two heat generating members 2 was set to be 15 $\mu$m. Moreover, the diameter do of the aperture of the discharge port 4 was set to be 10.5 $\mu$m, and the height OH of the aperture plane of the discharge port 4 from the top surface of a substrate 1 was set to be 40 $\mu$m.

In the configuration in which the aperture plane of the discharge port 4 and the surface of the substrate 1 are comparatively distant from each other as mentioned above, a bubble boiled on the heat generating members 2 is again coagulated to be liquefied without communicating with the outside air. Consequently, according to the configuration, the ends of liquid droplets do not adhere to the wall surfaces of the discharge port 4 to the contrary in the case of the configuration in which a bubble boiled on the heat generating members 2 communicate with the outside air. Consequently, it becomes difficult to produce flights of minute liquid droplets constructed at the end parts into different directions from those of the main liquid droplets.

Figure 6B:
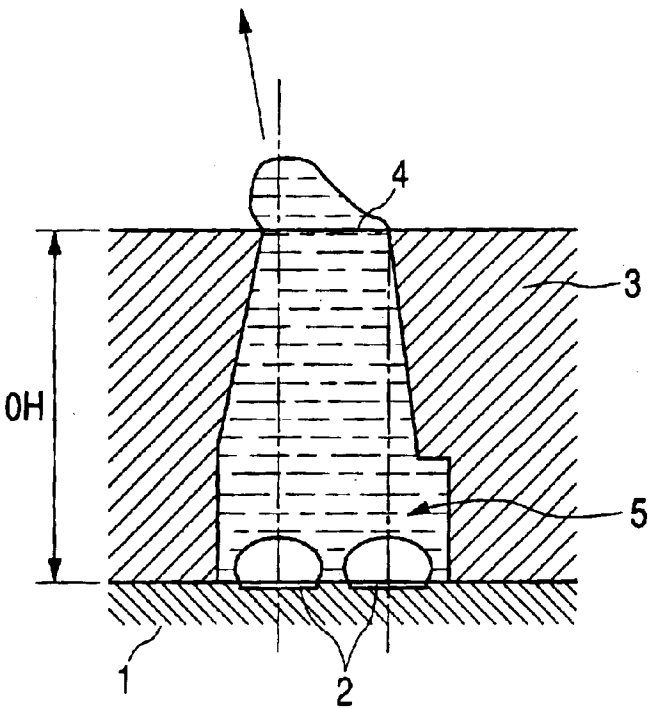
FIGS. 6A and 6B are views showing a case where the center position of the discharge port in the ink jet head shown in FIG. 5 is shifted from a point of symmetry of two heat generating members.
Figure 6A:
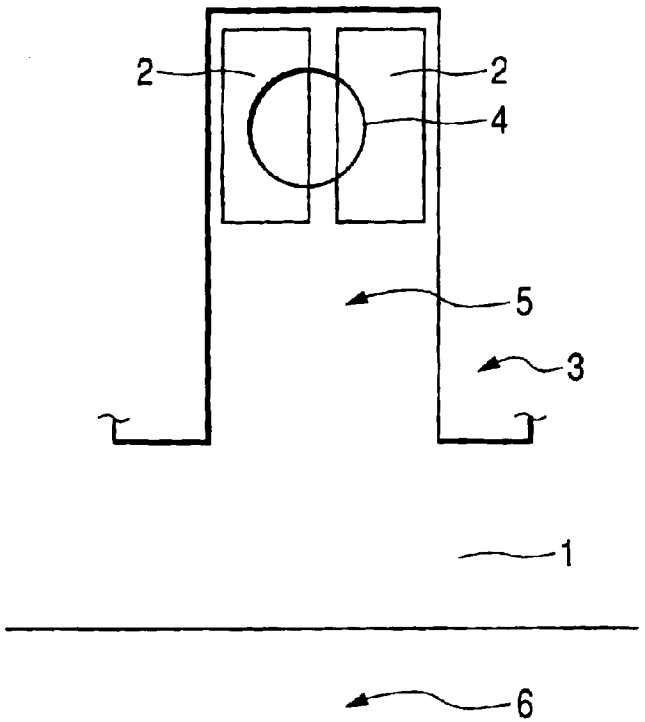

However, as shown in FIGS. 6A and 6B, if the center position of the discharge port 4 is shifted from the center position of the pressure generating area composed of the two heat generating members 2, the discharge directions of liquid droplets are easily influenced by a bubble generated by a heat generating member 2 on one side, which causes deviations in flight directions. FIGS. 6A and 6B are views showing a case where the center position of the discharge port 4 in the ink jet head shown in FIG. 5 is shifted from a point of symmetry of the two heat generating members 2. FIG. 6A is a plan view thereof, and FIG. 6B is a sectional view thereof.

The phenomenon in which the flight directions of liquid droplets are deviated by the shift of the center position of the discharge port 4 from the center position of the pressure generating area composed of the two heat generating members 2 as described above is especially easy to happen in case of discharging relatively small droplets, for example, equal to 5 pl or less owing to the following two primary factors.

As a first primary factor, it is cited that making the discharge port 4 smaller, which is necessary for discharging smaller liquid droplets, increases the fluid resistance of a pipe section including the discharge portion 4, which in turn makes the discharge speed low to make the discharge operation of liquid droplets unstable. As means for preventing this phenomenon, it is also considerable to shorten the distance OH of the aperture plane of the discharge port 4 from the substrate 1 to decrease the resistance of the flow passage in the pipe section. However, the means lowers the commutation operation of ink which is an operation of the pipe section including the discharge portion 4, and makes the liquid droplets discharged from the discharge port 4 be easily influenced by the bubble caused by the heat generating member 2 on one side. Consequently, the means makes the deviations produced in the flight directions of the liquid droplets larger on the contrary.

As a second principal factor, it can be cited that the movement of ink in the vicinity of the heat generating members 2 after the boiling of the ink easily produces differences according to positions to the heat generating members 2, since the sizes of the heat generating members 2 preferable to discharge small liquid droplets is smaller than those of the heat generating members 2 preferable to discharge large liquid droplets, and since division of a heat generating member having a certain size into a plurality of pieces makes the size of each of the divided pieces further smaller. If the heat generating members 2 are relatively large, a little differences of the positions of ink to the heat generating members 2 do not influence the movement of the ink in the vicinity of the heat generating members 2. However, the influences of the differences of the positions to the heat generating members 2 gradually become relatively larger as the sizes of the heat generating members 2 become smaller. Consequently, if the size of a heat generating member 2 becomes smaller, the discharge operation of liquid droplets becomes easy to be unequal.

The inkjet head of the present embodiment shown in FIG. 5 was devised with attention to such matters. The distance dhc of the centers of the two heat generating members 2 is set so that the respective center lines of the two heat generating members 2 related to the X directions being the flow directions of the ink are located at positions outside of the discharge port 4 projected on the pressure generating area composed of the two generating members 2, with putting the discharge port 4 between the center lines. Since, in this configuration, the deviations of the flight directions of liquid droplets to be generated by one side heat generating member 2 and the deviations of the flight directions of the liquid droplets to be generated by the other side heat generating member 2 are generated in directions opposite to each other, the deviations of the flight directions of the liquid droplets to be generated by one side heat generating member 2 are cancelled by the deviations of the flight directions of the liquid droplets to be generated by the other side heat generating member 2. Consequently, the deviations of the flight directions of liquid droplets can be reduced, and it becomes possible to stable the discharge directions of the liquid droplets.

Incidentally, the operation of canceling the deviations of the flight directions of the liquid droplets can be obtained as long as the respective center lines of the two heat generating members 2 are located at the positions outside of the discharge port 4 projected on the two heat generating members 2 with putting the discharge port 4 between the center lines, even if the center position of the discharge port 4 is shifted from the center position of the pressure generating area composed of the two heat generating members 2.

Fourth Embodiment

Figure 7A:
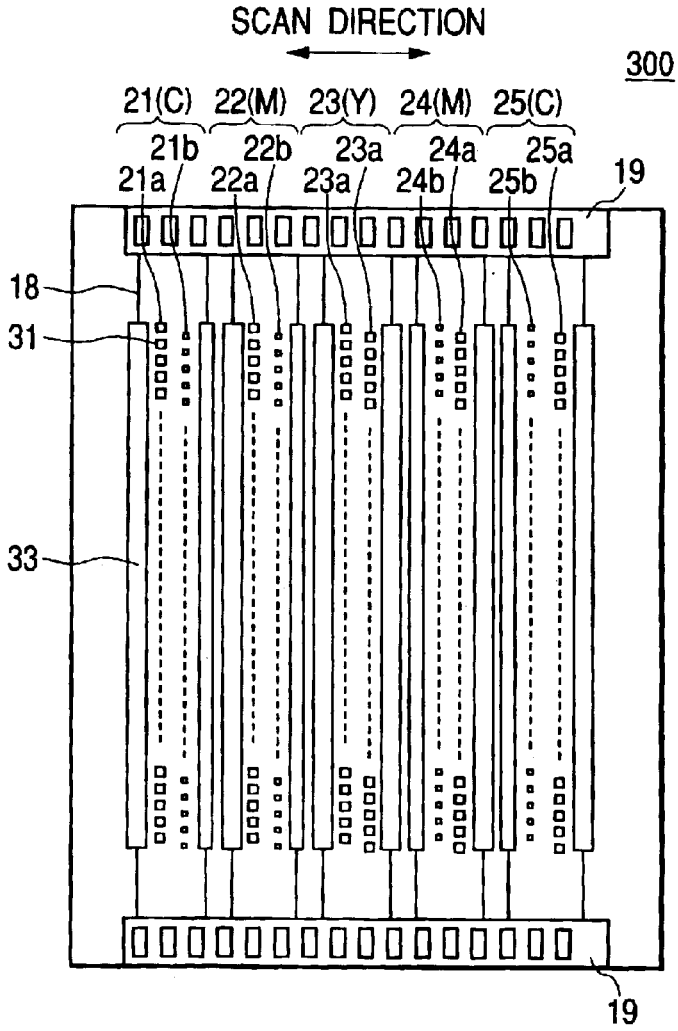
FIGS. 7A, 7B and 7C are views showing a substantial part of an ink jet head according to a fourth embodiment of the present invention typically.
Figure 7B:
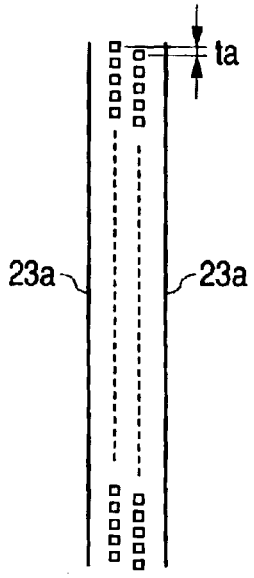
Figure 7C:
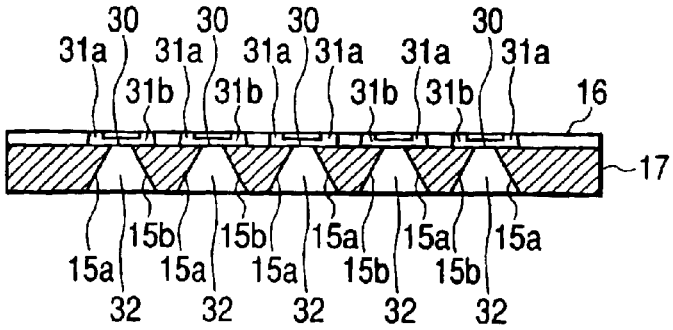

FIGS. 7A, 7B and 7C are views showing a substantial part of an ink jet head according to a fourth embodiment of the present invention typically, FIG. 7A is a plan view thereof, FIG. 7B is a view for the illustration of the arrangement of discharge port columns, and FIG. 7C is a sectional view thereof.

As shown in FIG. 7C, a recording head 300 of the present embodiment is provided with a substrate 17 including heat generating resistance devices 15*a* and 15*b* as energy conversion devices, and an orifice plate 16 including discharge ports 31 and ink flow passages 30 for feeding ink to the discharge ports 31.

The substrate 17 is formed with a single crystal of silicon having a plane direction (100). On the top surface of the substrate 1 (connection surface with the orifice plate 16) are formed by means of a semiconductor process the heat generating resistance devices 15*a* and 15*b*, driving circuits 33 composed of driving transistors and the like for driving these heat generating resistance devices 15*a* and 15*b*, contact pads 19 connected with a wiring board, which will be described later, wiring 18 connecting the driving circuits 33 with the contact pads 19, and the like. Moreover, the substrate 17 is therein provided with five through-holes formed by anisotropic etching in areas other than the areas in which the above-mentioned driving circuits 33, the heat generating resistance devices 15*a* and 15*b*, the wiring 18 and the contact pads 19. These through-holes form ink feed ports 32 for feeding liquid to discharge port columns 21*a*, 21*b*, 22*a*, 22*b*, 23*a*, 23*b*, 24*a*, 24*b*, 25*a* and 25*b*, which will be described later. Incidentally, FIG. 7A typically shows a state in which the substantially transparent orifice plate 16 is put on the substrate 17, and the drawing of the above-mentioned ink feed ports 32 is omitted.

The discharge port columns 21*a*, 21*b*, 22*a*, 22*b*, 23*a*, 23*b*, 24*a*, 24*b*, 25*a* and 25*b* are coupled by the twos communicating with the same ink feed ports 32 to constitute five coupled discharge port columns 21, 22, 23, 24 and 25. Among the coupled discharge port columns 21, 22, 23, 24 and 25, an ink having a cyan (C) color is fed to the coupled discharge port columns 21 and 25, an ink having a magenta (M) color is fed to the coupled discharge port columns 22 and 24, and an ink having a yellow (Y) color is fed to the coupled discharge port column 23. Moreover, in each coupled discharge port columns 21, 22, 23, 24 and 25, the adjoining discharge port columns are shifted from each other by ta in the arrangement directions as shown in, for example, FIG. 7B with regard to the coupled discharge port column 23.

The orifice plate 16 provided on the substrate 17 is formed with photosensitive epoxy resin. In the orifice plate 16, the discharge ports 31 and the liquid flow passages 30 are formed correspondingly to the above-mentioned heat generating resistance devices 15*a* and 15*b* by, for example, the process described in Japanese Patent Laid-Open Application No. 62-264957. Hereupon, it is desirable for producing a cheap and precise recording head to produce the recording head in conformity with the process disclosed in Japanese Patent Laid-Open Application No. 9-11479. That is, first a silicon oxide film or silicon nitride film (not shown) is formed on the silicon substrate 17; then, the orifice plate 16 provided with the discharge ports 31 and the liquid flow passages 30 is formed on the film; and finally the silicon oxide film or the silicon nitride film at the parts where the ink feed ports 32 are formed is removed by the anisotropic etching.

Figure 8A:
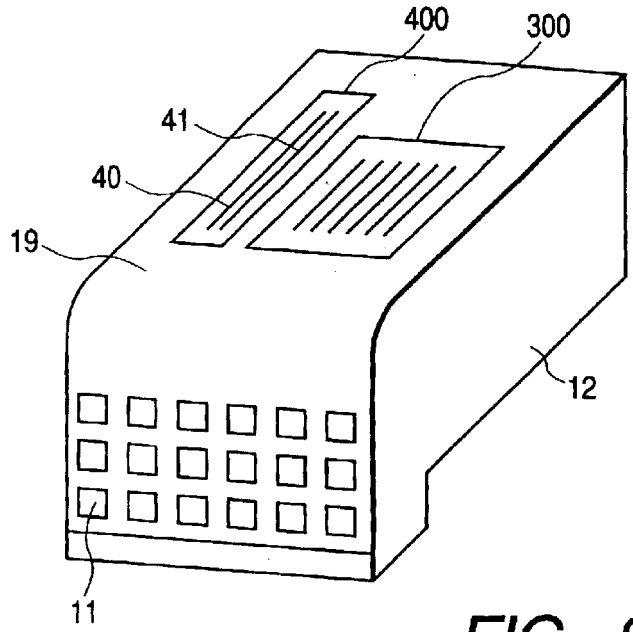
FIGS. 8A, 8B and 8C are views showing an example of an ink jet recording cartridge provided with the ink jet head shown in FIGS. 7A, 7B and 7C.
Figure 8C:
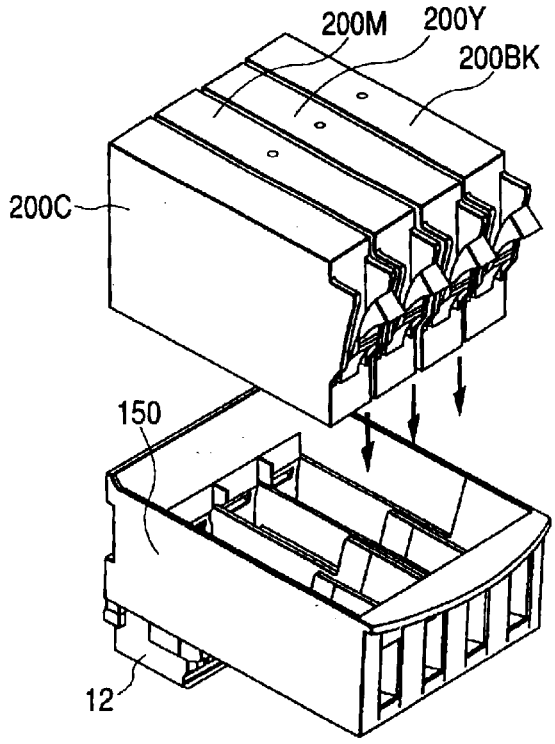
Figure 8B:
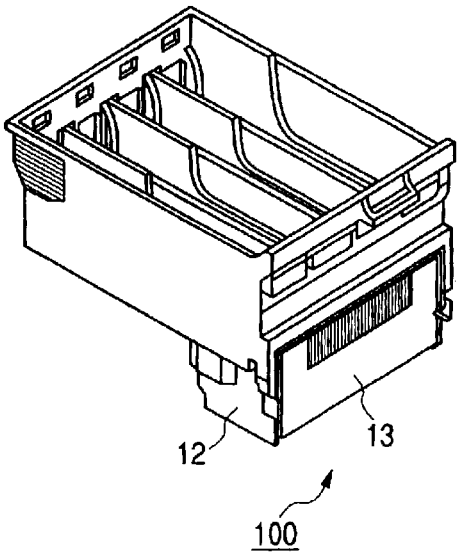

FIGS. 8A, 8B and 8C are vies showing an example of an ink jet recording cartridge equipped with the ink jet head shown in FIGS. 7A, 7B and 7C.

The recording head 300 provided with the substrate 17 and the orifice plate 16, both described above, utilizes the pressure of the bubble produced by film boiling caused by the heat energy applied by the heat generating resistance devices 15*a* and 15*b* to discharge liquid such as ink from the discharge ports 31 for performing recording. As shown in FIG. 8A, the recording head 300 is fixed on an ink flow passage forming member 12 for feeding ink to the ink feed ports 32. Then, the contact pads 19 are connected with a wiring board 13, and thereby the recording head 300 can receive drive signals and the like from a recording apparatus, which will be described later, when an electric connection portion 11 formed on the wiring board 13 is connected with an electric connection portion of the recording apparatus.

On the ink flow passage forming member 12, a recording head 400 provided with discharge portion columns 40 and 41 for discharging black ink (Bk) is fixed besides the recording head 300 capable of discharging each ink of Y, M and C. A recording head cartridge 100 capable of discharging four color ink is formed by combining the recording heads 300 and 400.

FIGS. 8B and 8C are perspective views showing an example of the recording head cartridge 100 equipped with the recording head 300. As shown in FIG. 8C, the recording head cartridge 100 is provided with a tank holder 150 for holding ink tanks 200Y, 200M, 200C and 200Bk for feeding inks to the ink flow passage forming member 12.

Referring to FIGS. 7A, 7B and 7C again, the recording head 300 of the present embodiment includes the one substrate 17 provided with 10 discharge port columns 21*a*, 21*b*, 22*a*, 22*b*, 23*a*, 23*b*, 24*a*, 24*b*, 25*a* and 25*b* and five slit-like ink feed ports 32, and each discharge portion column of each coupled discharge column is arranged in a line on both sides along the longitudinal direction of the ink feed portions 32.

The ink introduced into each of the ink feed ports 32 from each of the ink tanks 200Y, 2000M, 200C and 200Bk through the ink flow passage forming member 12 is fed to the obverse side of the substrate 17 from the reverse side thereof, and then is introduced to the discharge ports 31 through the ink flow passages 30 formed on the obverse side of the substrate 17. The introduced ink is then discharged from the discharge ports 31 by the pressures of the bubble produced by being heated and boiled by the heat generating resistance devices 15*a* and 15*b* provided in the vicinity of each of the discharge ports 31 on the obverse of the substrate 17.

As described above, inks of cyan (C), magenta (M), yellow (Y), magenta (M) and cyan (C) are fed to each of the ink feed ports 32 in order from the left side in FIG. 7A. Consequently, it is four discharge columns 21*a*, 21*b*, 25*a* and 25*b* that discharge the cyan ink; it is four discharge columns 22*a*, 22*b*, 24*a* and 24*b* that discharge the magenta ink; and it is two discharge columns 23*a* and 23*b* that discharge the yellow ink. When the recording head 300 is scanned into the left direction of an arrow in FIG. 7A, record is performed by discharging ink from the coupled discharge port columns 21, 22 and 23. When the recording head 300 is scanned into the right direction of the arrow in FIG. 7A, record is performed by discharging ink from the coupled discharge port columns 25, 24 and 23. By adopting the configuration in which each color ink is fed to each discharge port column in such a way, the order of the superposition of ink colors on a recording medium becomes the same in both of the times of movements of the recording head 300 into the outward direction and the return direction in both cases where record is performed while the recording head 300 is moved into any of both directions of the arrow directions in FIG. 7A. Consequently, it becomes possible to record a high quality image at a high speed without any color shading.

In the recording head 300 of the present embodiment, the coupled discharge port columns 21 and 25 for discharging the cyan ink and the coupled discharge port columns 22 and 24 for discharging the magenta ink composed of two discharge port columns having discharge ports different in the sizes of the liquid droplets to be discharged therefrom. That is, the coupled discharge port columns 21 and 25 for discharging the cyan ink are composed of the discharge port columns 21*a* and 25*a* for discharging relatively large liquid droplets and the discharge port columns 21*b* and 25*b* for discharging relatively small liquid droplets. Moreover, the coupled discharge port columns 22 and 24 for discharging the magenta ink are composed of the discharge port columns 22*a* and 24*a* for discharging relatively large liquid droplets and the discharge port columns 22*b* and 24*b* for discharging relatively small liquid droplets.

Correspondingly to this, a relatively large heat generating resistance device 15*a* is provided in each of the discharge ports in the discharge port columns 21*a*, 22*a*, 23*a* and 24*a* for discharging relatively large liquid droplets, and a relatively small heat generating resistance device 15*b* is provided in each of the discharge ports in the discharge port columns 21*b*, 22*b*, 23*b* and 24*b* for discharging relatively small liquid droplets.

According to the configuration described above, it becomes possible to perform high quality recording while keeping the high speed of recording operation by using the discharge ports to be used for recording properly like by the way in which the parts of an image to be recorded where highly precise recording is required are recorded by the use of the discharge ports 31*b* for discharging relatively small liquid droplets and the other parts are recorded by the use of the discharge ports 31*a* for discharging relatively large liquid droplets. For achieving the high image quality and the high speed at the best balance, it is preferable to set the ratios of the quantities (largeness) of the liquid droplets to be discharged from each discharge port in the discharge port columns 21*a*, 22*a*, 24*a* and 25*a* for discharging relatively large liquid droplets to the quantities (largeness) of the liquid droplets to be discharged from each discharge port in the discharge port columns 21*b*, 22*b*, 24*b* and 25*b* for discharging relatively small liquid droplets to be 2:1 or more.

Moreover, the coupled discharge port column 23 for discharging the yellow ink is composed of two discharge port columns 23*a* for discharging relatively large liquid droplets, and relatively large heat generating resistance devices 15*a*, which are the same ones used in the discharge port columns 21*a*, 22*a*, 24*a* and 25*a*, are provided in each discharge port in each of the discharge port train 23*a*.

In the present embodiment, each discharge port 31*a* of the discharge port columns 21*a*, 22*a*, 23*a*, 24*a* and 25*a* for discharging relatively large liquid droplets is formed to be an ellipse sized to be 19.5 μm in the diameter in each ink flow direction in each of the ink flow passages 30 and to be 12 μm in the diameter in the direction orthogonal to the above-mentioned direction, and each discharge port 31*b* of the discharge port columns 21*b*, 22*b*, 23*b*, 24*b* and 25*b* for discharging relatively small liquid droplets is formed to be a circle having the diameter of 11 μm. In each of the ink flow passages 30 provided with discharge ports 31*a* for discharging relatively large liquid droplets, two heat generating resistance devices 15*a* having the width of 12 μm and the length of 28 μm are arranged with the interval of 4 μm from each other while the distance between the centers of them is set to be 16 μm. On the other hand, in each of the ink flow passages 30 provided with discharge ports 31*b* for discharging relatively small liquid droplets, two heat generating resistance devices 15*b* having the width of 12 μm and the length of 27 μm are arranged with the interval of 3 μm from each other while the distance between the centers of them is set to be 15 μm. Incidentally, the thickness of the flow passage forming member (orifice plate 16) is 25 μm, and the heights of the flow passages (the height from the surface of the substrate 17 to the aperture plane of the discharge ports 31*a* and 31*b*) are formed to be 13 μm commonly to both discharge ports 31*a* and 31*b*.

The recording head 300 configured in the way described above stably discharge the liquid droplets of about 5 pl from the discharge ports 31*a* for discharging relatively large liquid droplets and the liquid droplets of about 2.5 pl from the discharge ports 31*b* respectively. Consequently, high quality images can be obtained owing to the superior impact precision and the dot shapes of the recording head 300.

Incidentally, although the optimum configuration is described in the present embodiment, it is possible to change the kinds of inks to be fed from each ink feed port 32, the ink feed ports 32 and the number of the discharge port columns suitably without being limited to the configuration described above.

Other Embodiments

Figure 9:
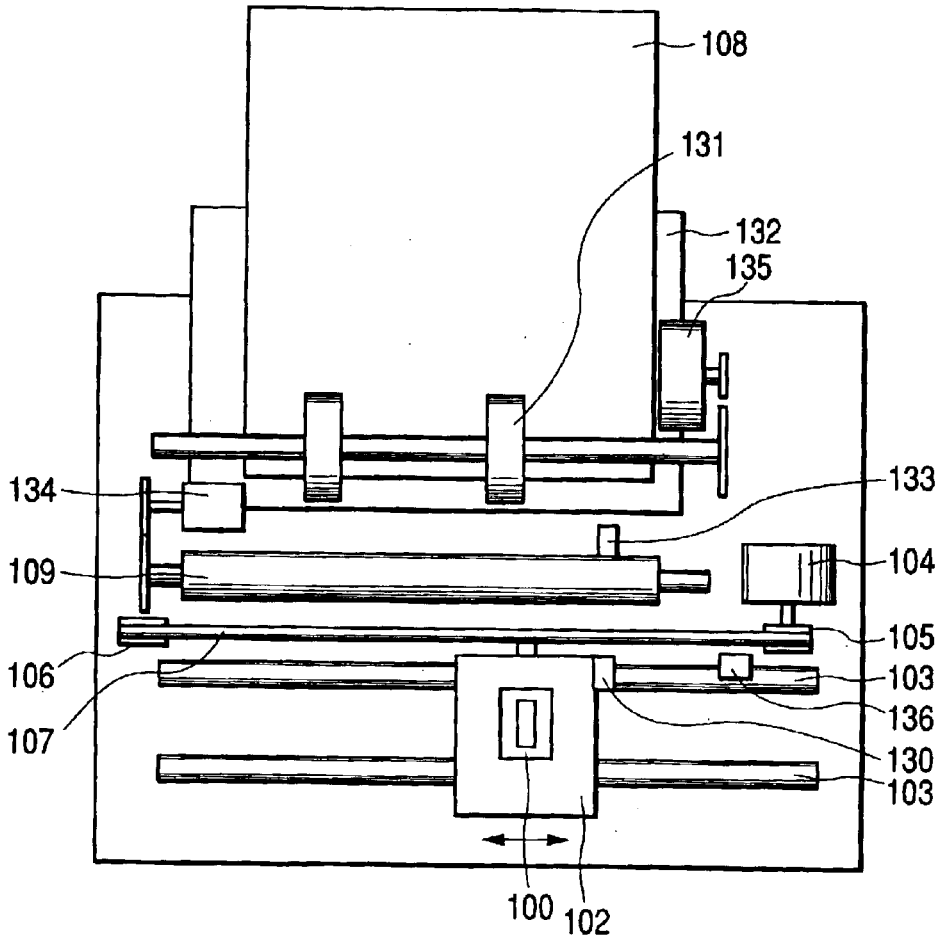
FIG. 9 is a schematic diagram showing an example of a recording apparatus capable of mounting an ink jet head of the present invention.

Finally, a recording apparatus capable of mounting the ink jet heads or the recording head cartridges, both described in each embodiment described above, will be described by reference to FIG. 9. FIG. 9 is a schematic diagram showing an example of a recording apparatus capable of mounting an ink jet head of the present invention.

As shown in FIG. 9, the recording head cartridge 100 is exchangeably mounted in a carriage 102. The recording head cartridge 100 is provided with a recording head unit and ink tanks. The recording head cartridge 100 is also provided with a connector (not shown) for transferring signals such as one for driving a head section and the like.

The recording head cartridge 100 is exchangeably mounted on the carriage 102 at a fixed position. The carriage 102 is provided with an electric connection section for transmitting driving signals and the like to each head section.

The carriage 102 is supported by guide shafts 103, which is installed in the main body of the apparatus to extend in the main scanning direction (the arrow direction in the figure), in a manner capable of performing reciprocating movements while being guided by the guide shafts 103 along them. The carriage 102 is driven by a main scanning motor 104 through driving mechanisms such as a motor pulley 105, a driven pulley 106, a timing belt 107 and the like. The positions and the movements of the carriage 102 are also controlled by the components mentioned above. Moreover, a home position sensor 130 is provided on the carriage 102. Thereby, by detecting that the home position sensor 130 on the carriage 102 has passed through the position of a shielding board 136, it can be known that the carriage 102 has been located at the home position.

A recording medium 108 such as a sheet of record paper, a plastic thin board and the like is separated one by one from an automatic sheet feeder 132 to be fed by the driving of a paper feeding motor 135 to rotate pickup rollers 131 through gears. The recording medium 108 is conveyed (sub-scanning) through a position (print section) opposed to the surface of discharge ports of the head cartridge 100 by rotations of a conveyance roller 109. The conveyance roller 109 is rotated by the driving force transmitted from an LF motor 134 through gears when the LF motor 134 is driven. At that time, the judgment whether the recording medium 108 has actually been fed or not, and the decision of the head position at the time of feeding are preformed at the point of time when the tip portion of the recording medium 108 in the conveyance direction has passed through a paper end sensor 133. Moreover, the paper end sensor 133 is also used for detecting the position where the rear end of the recording medium 108 actually exists to calculate the present recording position finally on the basis of the position of the actual rear end.

Incidentally, the reverse side of the recording medium 108 is supported by a platen (not shown) for forming a flat print surface at the print portion. In this case, the recording head cartridge 100 mounted on the carriage 102 is held with the surface of the discharge ports projecting downward from the carriage 102 to be parallel to the recording medium 108.

The recording head cartridge 100 is mounted on the carriage 102 with the arrangement direction of the discharge port columns crossing the scanning direction of the carriage 102. Record on the recording medium 108 is performed by repeating the operation of performing record in the main scanning direction by scanning the recording head cartridge 100 while discharging ink from the discharge port columns and the operation of conveying the recording medium 108 in the sub-scanning direction by the record width of one scanning by means of the conveyance roller 109.

As described above, the ink jet head of the present invention sets the distance dhc between the centers of each of two heat generating members arranged at positions farthest from each other among a plurality of heat generating members provided in each ink flow passage to be larger than the diameter do of the aperture of a discharge port. Consequently, even if the center position of the discharge port is somewhat shifted from the center position of a pressure generating area, liquid columns of ink to be discharged through the discharge port do not touch the side wall surfaces of the discharge port. Consequently, it is possible to discharge ink liquid droplets from the discharge port without any shifts of the discharge directions of the ink liquid droplets. Moreover, by adopting the configuration of connecting these plurality of heat generating members in series electrically with wiring, a resistance value higher than that of a one-body heat generating member having the same size of the plural heat generating members can be obtained, which makes it possible to reduce a necessary current value. Consequently, the discharge efficiency of the ink jet head can be heightened.

Moreover, in another ink jet head of the present invention, the center lines of respective two heat generating members with respect to an ink flow direction are located at the outside of a discharge port projected on a pressure generating area, which members are arranged at the most distant positions from each other with respect to the direction between partition walls partitioning each ink flow passage, which direction is orthogonal to the ink flow direction flowing in each ink flow passage toward the pressure generating area, among a plurality of heat generating members provided in each ink flow passage. Consequently, even if the center position of the discharge port and the center position of the pressure generating area are somewhat shifted from each other, the deviations of the flight directions of liquid droplets are reduced to make it possible to stable the discharge directions of the liquid droplets, since the deviations of the flight directions of the liquid droplets which deviations can be produced by a heat generating member on one side is cancelled by the deviations of the flight directions of the liquid droplets which deviations can be produced by the other heat generating member on the other side.

What is claimed is:

1. An ink jet head including a substrate provided with heat generating elements for generating bubbles in ink on a surface of said substrate, a plurality of discharge ports for discharging the ink, said discharge ports opposed to said surface of said substrate, and a plurality of ink flow passages communicating with said plurality of discharge ports, respectively, to feed the ink, said ink jet head discharging the ink from said discharge ports by pressure generated by generating the bubbles, wherein a plurality of said heat generating elements is provided in each of said ink flow passages, and for each ink flow passage said respective discharge port is arranged on an extension line extending from a center of a pressure generating area including said plurality of heat generating elements toward the surface of said substrate in a normal direction, and a distance dhc between center lines, with respect to an ink flow direction, of each of two heat generating elements arranged farthest apart from each other among said plurality of heat generating elements in a given one of said ink flow passages is larger than a diameter do of an aperture of said discharge port corresponding to the given ink flow passage.

2. An ink jet head according to claim 1, wherein, if the center of said discharge port is shifted from the extension line by a distance derr, then the distance dhc, the diameter do and the distance derr satisfy the relation:

$dhc > do + derr \times 2$.

3. An ink jet head according to claim 1, wherein at least two heat generating elements among said plurality of heat generating elements provided in a given one of said ink flow passages are arranged with a certain interval dhh therebetween with respect to a direction between partition walls partitioning each of said ink flow passages, and the interval dhh between two adjacent heat generating elements that are farthest apart from each other with respect to the direction between said partition walls among said plurality of heat generating elements in the given ink flow passage is at least twice as long as an interval dhn between any of said partition walls and said heat generating element adjacent to said partition wall in the given ink flow passage.

4. An ink jet recording head according to claim 1, wherein, in each of said ink flow passages, said plurality of heat generating elements provided therein are connected in series.

5. An ink jet head including a substrate provided with heat generating elements for generating bubbles in ink on a surface of said substrate, a plurality of discharge ports for discharging the ink, said discharge ports opposed to said surface of said substrate, a plurality of ink flow passages communicating with said plurality of discharge ports, respectively, to feed the ink, and a flow passage forming member provided on said surface of said substrate, said ink jet head discharging the ink from said discharge ports by pressure generated by generating the bubbles, wherein a plurality of said heat generating elements is provided in each of said ink flow passages, and for each ink flow passage said respective discharge port is arranged on an extension line extending from a center of a pressure generating area including said plurality of heat generating elements toward the surface of said substrate in a normal direction, and for each ink flow passage, center lines, with respect to an ink flow direction, of each of two heat generating elements provided in the ink flow passage are located outside of a projection area of said respective discharge port projected above said pressure generating area, said two heat generating elements being arranged farthest apart from each other with respect to the direction between partition walls partitioning each of said ink flow passages, which is the direction orthogonal to the ink flow direction of ink flowing in each of said ink flow passages toward said pressure generating area, among said plurality of heat generating elements in the given ink flow passage.

6. An ink jet head according to claim 5, wherein the bubbles disappear without communicating with outside air through said discharge port.

7. An ink jet recording head according to claim 5, wherein, in each of said ink flow passages, said plurality of heat generating elements provided therein are connected in series.

8. An ink jet recording head for discharging ink to record, said head comprising:

a substrate having a plurality of heat generating elements for causing ink to generate a bubble;

a plurality of discharge ports provided opposite to a surface of said substrate on which said heat generating elements are provided, each of said discharge ports for discharging the ink by the pressure caused by the bubble; and a plurality of ink flow paths communicating with said discharge ports, respectively, to supply the ink thereto, wherein, in each of said ink flow paths, two of said heat generating elements having the same size and a rectangular shape are electrically connected in series, and a shorter side of one of said two heat generating elements is located at a distance from and along the same line as a shorter side of the other of said two heat generating elements, and wherein, in each of said ink flow paths, if a center line of one of said two heat generating elements passing through a center of said one heat generating element is parallel to a longer side of said one heat generating element, said respective discharge port is located between the center lines of said two heat generating elements when said discharge port is projected to said substrate.

9. An ink jet recording head for discharging ink to record, said head comprising:

a substrate having a plurality of heat generating elements for causing ink to generate a bubble;

a plurality of discharge ports provided opposite to a surface of said substrate on which said heat generating elements are provided, each of said discharge ports for discharging the ink by pressure caused by the bubble;

a plurality of ink flow paths communicating with said discharge ports, respectively, to supply the ink thereto, wherein, in each of said ink flow paths, two of said heat generating elements having the same size and a rectangular shape are electrically connected in series, and a shorter side of one of said two heat generating elements is located at a distance from and along the same line as a shorter side of the other of said two heat generating elements, and wherein a distance between center lines, with respect to an ink flow direction, of said two heat generating elements is larger than a diameter of an aperture of said discharge port.

* * * * *

UNITED STATES PATENT AND TRADEMARK OFFICE

CERTIFICATE OF CORRECTION

PATENT NO. : 6,984,025 B2
APPLICATION NO. : 10/419131
DATED : January 10, 2006
INVENTOR(S) : Mineo Kaneko et al.

It is certified that error appears in the above-identified patent and that said Letters Patent is hereby corrected as shown below:

COLUMN 1
Line 7, "record" should read --recording--.

COLUMN 3
Line 25, "stable" should read --makes stable--; and "sized" should read --size--.
Line 54, "stabled" should read --made stable--.

COLUMN 7
Line 47, "is" should read --to be--.

COLUMN 8
Line 35, "not" should read --not been--.
Line 50, "arrange" should read --arranged--.
Line 56, "the-pressure" should read --the pressure--.

COLUMN 9
Line 11, "stabled." should read --made stable.--.
Line 29, "defied" should read --defined--.

COLUMN 11
Line 15, "stable" should read --make stable--.

UNITED STATES PATENT AND TRADEMARK OFFICE

CERTIFICATE OF CORRECTION

PATENT NO. : 6,984,025 B2
APPLICATION NO. : 10/419131
DATED : January 10, 2006
INVENTOR(S) : Mineo Kaneko et al.

It is certified that error appears in the above-identified patent and that said Letters Patent is hereby corrected as shown below:

COLUMN 12
Line 23, "is" should read --are--.
Line 27, "vies" should read --views--.

COLUMN 15
Line 37, "preformed" should read --performed--.

COLUMN 16
Line 28, "stable" should read --make stable--.

Signed and Sealed this

Twenty-fifth Day of December, 2007

JON W. DUDAS
*Director of the United States Patent and Trademark Office*